United States Patent [19]

Lang et al.

[11] 4,264,555

[45] Apr. 28, 1981

[54] PROCESS FOR PRODUCTION OF MONOFILAMENTS FROM POLYVINYLIDENE FLUORIDE

[75] Inventors: Egon Lang; Wilhelm Nachtigall; Joachim Stark, all of Troisdorf, Fed. Rep. of Germany

[73] Assignee: Dynamit Nobel AG, Troisdorf, Fed. Rep. of Germany

[21] Appl. No.: 69,488

[22] Filed: Aug. 24, 1979

[30] Foreign Application Priority Data

Aug. 30, 1978 [DE] Fed. Rep. of Germany ..... 2837751

[51] Int. Cl.[3] ..... D01D 1/04

[52] U.S. Cl. ..... 264/176 F; 264/178 F

[58] Field of Search ..... 526/250; 264/176 F, 264/178 F

[56] References Cited

U.S. PATENT DOCUMENTS

| | | | |
|---|---|---|---|
| 3,376,370 | 4/1968 | Koblitz et al. | 264/184 |
| 3,707,592 | 12/1972 | Ishi et al. | 264/210.6 |
| 3,941,860 | 3/1976 | Couchoud et al. | 264/178 F |
| 4,039,634 | 8/1977 | Couchoud et al. | 264/210.8 |

FOREIGN PATENT DOCUMENTS

| | | | |
|---|---|---|---|
| 49-25069 | 3/1974 | Japan | 264/178 F |

*Primary Examiner*—Jay H. Woo

*Attorney, Agent, or Firm*—Sprung, Felfe, Horn, Lynch & Kramer

[57] ABSTRACT

A process for the production of monofilaments of polyvinylidene fluoride is disclosed wherein polyvinylidene fluoride is plasticized in an extruder and fed to an extrusion die and passed through an extrusion nozzle orifice to enter a liquid cooling medium having a thermal conductivity of under 0.4 W/m °K., a viscosity at 100° C. of over 0.5 cp and a density at 100° C. of over 1.1 g/cm$^3$. Extusion is performed by passing the plasticized polyvinylidene fluoride over separate extrusion zones such as by passing the polyvinylidene fluoride over a first extrusion zone maintained at a first extrusion temperature and thereafter passing the polyvinylidene fluoride through a second extrusion zone maintained at a temperature of 10 to 30 percent higher than the preceeding extrusion zone. An apparatus for carrying out the process is also described.

15 Claims, 5 Drawing Figures

PROCESS FOR PRODUCTION OF MONOFILAMENTS FROM POLYVINYLIDENE FLUORIDE

BACKGROUND OF THE INVENTION

1. Field of the Invention

The invention relates to a process for the production of monofilaments from polyvinylidene fluoride wherein the latter, hereinafter referred to as PVDF, is plasticized with an extruder and formed into monofilaments in an extrustion die, followed by a cooling in a liquid bath. The associated apparatus comprises an extruder with an extrusion die, preferably constructed as a multihole head, whose nozzle is provided with at least one orifice, usually a plurality of orifices arranged in a circle, and a liquid-cooled cooling tank having a guide roll and takeoff means.

2. Discussion of the Prior Art

Prior-art apparatuses for the extrusion of plastic filaments are described, for example, on pages 438 to 444 of the book KUNSTSTOFF-EXTRUDERTECHNIK, by Dr. Ing. Schenkel, Carl Hanser Verlag, Munich 1963. An important consideration in the production of monofilaments is the achievement of a smooth surface, good extensibility and minimum diameter variations, in other words, maximum roundness of monofilaments which are to have a circular cross-section. The known installations for extrusion of monofilaments from polyethylene, polypropylene, polyamides, polystyrene and polyvinyl chloride have not permitted these requirements to be met by monofilaments made of PVDF. PVDF is a partially crystalline thermoplastic material whose degree of crystallinity depends to a large extent on its thermal pretreatment history. Rapid cooling after processing yields a largely amorphous material of high transparency and good flexibility while slow cooling, particularly over the temperature range in which the recrystallization rate is highest, which in the case of PVDF is between about 130° and 140° C., results in a highly crystalline material which, though less transparent, with higher density has greater tensile and flexural strength and improved compression creep strength. Since the monofilaments must have both high shape retention and good stretchability, a high degree of crystallinity is desirable.

Air cooling at 110° to 120° C., which has proved itself in the cooling of polystyrene monofilaments, has been found to be satisfactory for the cooling of PVDF monofilaments since the latter, because of their weight, are drawn out very thin. This has resulted in considerable diameter variations and deviations from the desired cross-sectional configuration. Moreover, these monofilaments run very unsteady, given the very long cooling path needed with air cooling. On the other hand, the use of water cooling for solidification of PVDF monofilaments is not the ideal solution, either, since with water cooling the monofilaments are cooled too rapidly and therefore traverse the optimum recrystallization range too quickly, with the result that they have an insufficient degree of crystallization and hence, inadequate shape retention. When the monofilaments then pass over the guide roll and move on, they undergo undesirable deformation of their cross-section.

A further problem in the extrusion of monofilaments is posed by the required narrow tolerances and constant cross-sections of the monofilaments. These requirements must be met not only during the cooling phase of the extruded monofilaments but already during extrusion. This calls for identical lengths of the flow paths, identical flow rates, and a uniform temperature pattern for all monofilaments. Still, the additional problem that the freshly extruded monofilaments do not have a sufficiently smooth surface remains.

SUMMARY OF THE INVENTION

In accordance with the invention, a process is provided for the production of polyvinylidene fluoride monofilaments having the desired physical properties set forth above. The process of the invention comprises:

A. extruding polyvinylidene fluoride through a die over a first path at a first extrusion temperature and thereafter over a subsequent path at a temperature of 10 to 30 degrees C., preferably 15 to 25 degrees C., higher than the temperature of the first path; and B. passing the so extruded polyvinylidene fluoride through a cooling bath maintained at a temperature of 60° to 140° C., preferably 90° to 110° C., said cooling bath containing a cooling medium having a thermal conductivity of under 0.40 W/m °K, and preferably under 0.3 W/m °K, a viscosity at 100° C. of over 0.5 cp, and preferably over 1.4 cp, and a density at 100° C., of over 1.1 g/cm$^3$, and preferably over 1.2 g/cm$^3$.

In a preferred embodiment of the invention, the monofilament which has been extruded but not yet cooled is caused to traverse a short air cooling path. Thereafter it enters the liquid cooling medium. This air cooling path can have a length of 10 to 250 mm but is preferably of a length from 50 to 100 mm.

The process of the invention can be carried out in an apparatus comprising an extruder, said extruder having an extrusion die in fluid communication with and thermally isolated from an extrusion nozzle, said extrusion nozzle equipped with at least one orifice, said orifice being in fluid communication with a cooling bath, said cooling bath containing a liquid cooling medium maintained at a temperature of 60° to 140° C., preferably 90° to 110° C., said cooling medium having a thermal conductivity of under 0.40 W/m °K, and preferably under 0.3 W/m °K, a viscosity at 100° C. of over 0.5 cp, and preferably over 1.4 cp, and a density at 100° C. of over 1.1 g/cm$^3$, and preferably over 1.2 g/cm$^3$.

The apparatus of the invention preferably comprises an extruder having an extrusion die constructed as a multihole head in which the nozzle is provided with nozzle orifices disposed in a circle. Preferably, the liquid cooled cooling medium is disposed within a cooling tank containing a guide roll and takeoff means. The nozzle with the nozzle orifices is thermally isolated from the extrusion die and is provided with heating means which surrounds the nozzle orifices externally and internally.

In carrying out the process, the polyvinylidene fluoride is normally plasticized by heating the same at a temperature of 220° to 280° C., preferably 240° to 260° C. while passing the same over a first extrusion path. Thereafter the temperature during a subsequent or final stretch through the extrusion die is adjusted to 10 to 30 degrees C., preferably 15 to 25 degrees C. higher than the temperature in the preceeding extrusion zone.

Thereafter the emerging so extruded monofilament is cooled, optionally after traversing a short air cooling path, in the cooling medium. The cooling medium can have a thermal conductivity as low as 0,1 W/m °K, a viscosity as high as 10 cp determined at 100° C. and a density of up to 1,8 g/cm$^3$ determined at 100° C.

The process in accordance with the invention permits the production of PVDF monofilaments having a smooth surface, good stretchability, very good roundness, and small diameter variations of under 2 percent, and preferably under 1 percent, with diameters of the cooled but as yet undrawn monofilaments ranging from 0.2 to 1.1 mm.

When the monofilaments are in addition heated as they exit from the extrusion die, their surface smoothness is enhanced. High crystallinity and shape retention of the extruded monofilaments along with small deviations from the required diameters are obtained by selecting a cooling medium which has a lower thermal conductivity and higher viscosity than water. The low thermal conductivity of the cooling medium results in slower cooling of the PVDF monofilaments and hence prolongs the time during which the PVDF monofilaments traverse the temperature range in which the recrystallization rate is highest, which is between about 130° and 140° C. PVDF monofilaments formed with a higher degree of crystallinity, and hence greater orientation, possess higher tensile and flexural strength and shape retention so that they undergo no cross-sectional deformation as they pass over the guide roll in the cooling bath and subsequently can readily be drawn out. Dimensional stability and shape retention of the PVDF monofilaments are assured by the process of the invention.

When the retention time of the PVDF monofilaments in the optimum recrystallization temperature range is too short, as is the case with air or water cooling, for example, then the length of time for which they must be retained in the selected cooling medium in order to develop sufficient shape retention for passing over guide rolls without sustaining distortion must be correspondingly, greater. Generally, the fibers are cooled in accordance with the invention in the cooling medium for at least 4 seconds and preferably 6 to 30 seconds.

However, the more the depth of immersion of the monofilaments in the cooling bath or the time of their passage through the latter is increased, the less steady their motion will be. Now perfectly steady motion is essential also in their passage through the cooling medium if monofilaments as nearly true to size as possible are to be obtained. In the process of the invention, the depth of immersion of the monofilaments is selected at 200 to 2000 mm, and preferably at 500 to 1000 mm. Depth of immersion here means the length of the path between the point where the monofilaments enter the cooling medium and the point where they pass over the guide roll.

In accordance with the invention, the preferred cooling medium is glycerin. Since some cooling medium such as glycerin usually adheres to the monofilments leaving the bath, it is advisable to remove the adhering cooling medium from the cooled monofilments, which may be done mechanically, for example, by means of rolls and sponges, followed by a water bath.

Other cooling mediums useful in accordance with the invention include: 1.2-ethandiol or mixtures with water and glycol or glycerin.

With the process in accordance with the invention one can pass the monofilaments through an air space, usually a short one ranging from 10 to 250 mm, and preferably from 50 to 100 mm, after they leave the extrusion die and before they enter the actual cooling medium.

The apparatus designed for the practice of the process of the invention is characterized in that the nozzle with its orifices is thermally isolated from the extrusion die and is provided with controllable heating means which externally and internally surround the circle of nozzle orifices, and that the cooling tank is filled with a cooling medium as specified above and maintained at an adjustable temperature of from 60° to 140° C., and preferably from 90° to 110° C.

Through the heating means which in accordance with the invention can be provided in the exit area of the nozzles, internally and externally of the nozzle orifices, the possibility of a nonuniform melt temperature is definitely eliminated. A nonhomogeneously heated melt, and hence uneven heating of the monofilaments, results in their deformation, and thus in nonuniform cross-sections. Maintaining the nozzle exit area at a higher temperature also provides further smoothing of the monofilament surface. However, to prevent or minimize the transfer of heat from the nozzle exit area, maintained at a higher temperature, to the rest of the extrusion die, provision is made for thermal isolation. The nozzle exit area may be thermally isolated from the remainder of the extrusion die by joining the nozzle to the extrusion die through a web ring, for example, with the various nozzle bores for the monofilaments extending in the area of the web ring. With a view to satisfying even stringent requirements on the dimensional accuracy and uniformity of the PVDF monofilaments, it is proposed that as a refinement of the invention the extrusion die itself be also provided with external and internal heating means.

BRIEF DESCRIPTION OF DRAWINGS

The invention will now be explained in greater detail with reference to the drawing illustrating embodiments, wherein:

FIG. 1 shows diagrammatically an installation for the production of PVDF monofilaments in which the latter are conducted to a winding device. The PVDF plasticized in the extruder 1 at 275° C., for example, is formed into monofilaments 2 by means of the extrusion die, constructed as a multiaperatured-head disk. After traversing a short air space, which will not be described in detail, the monofilaments 2 enter the cooling liquid 5, preferably glycerin, contained in the tank 4. After traversing a cooling path that is measured from the point where the monofilaments enter the cooling bath to the shaft of the driven guide roll 6 disposed in the cooling bath, the monofilaments pass over the fluted guide roll 6, travel upwardly to leave the cooling tank 4, and pass over further guide rolls 8 through a drip basis 9 for the glycerin, for example, and a rinse tank 10, which may be filled with water, for example, and then over takeoff rolls 11 to the winding device 12.

Figure 1:
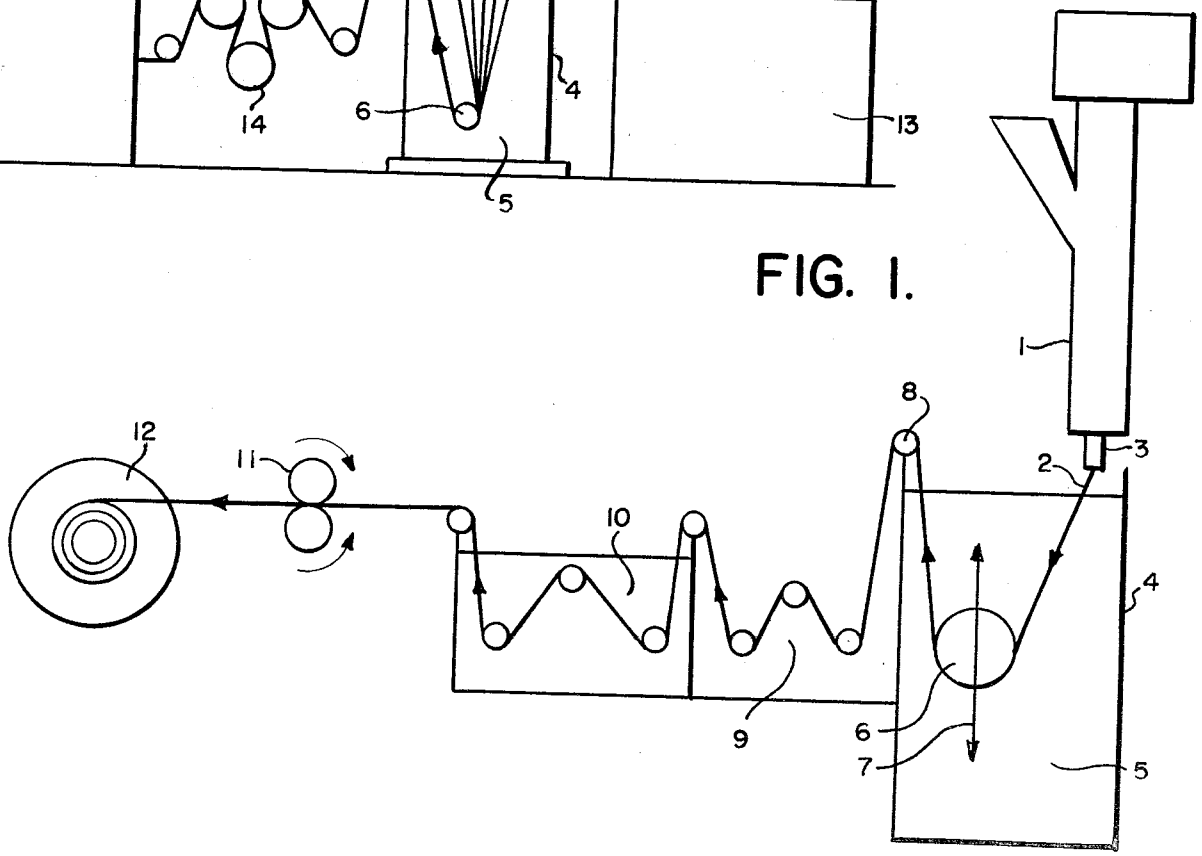
FIGS. 1 and 2 are diagrammatic cross-sectional views through an installation for the production of PVDF monofilaments.
Figure 2:
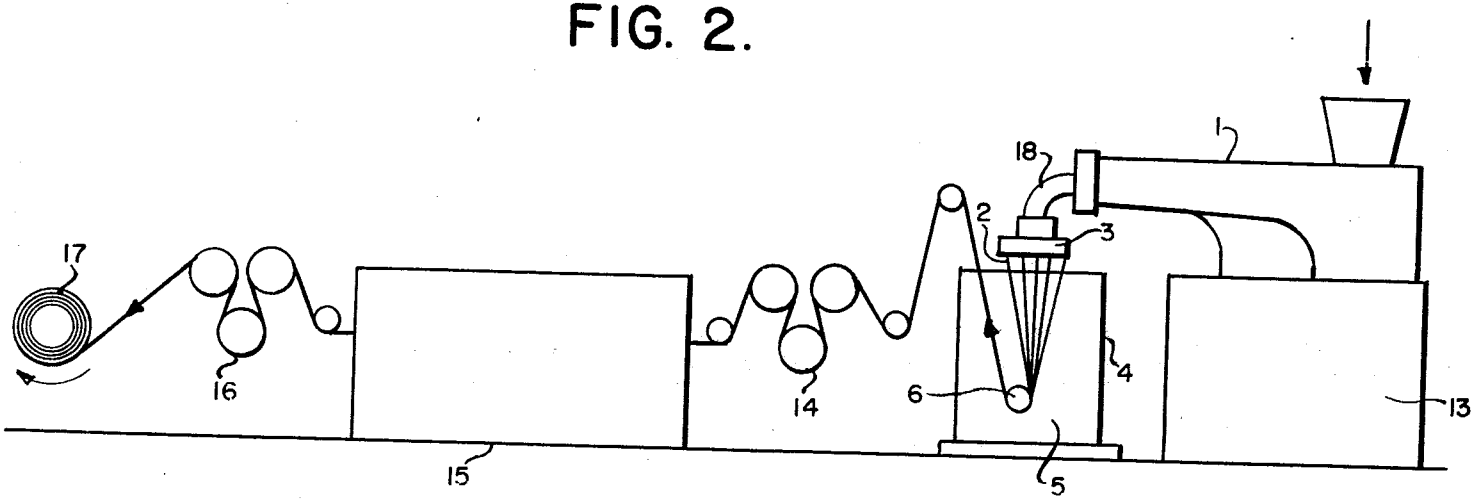

Shown diagrammatically in FIG. 2 is another variant of the process for the production of PVDF monofilaments, the extruder 1 being mounted horizontally on a base 13 and the extrusion die 3 being joined to the extruder through a pipe elbow 18. After emerging from the cooling tank 4, the monofilaments 2 are conducted through takeoff means 14 directly to a drawing unit 15, following which they are wound onto the device 17 by way of further takeoff means 16.

Figure 3:
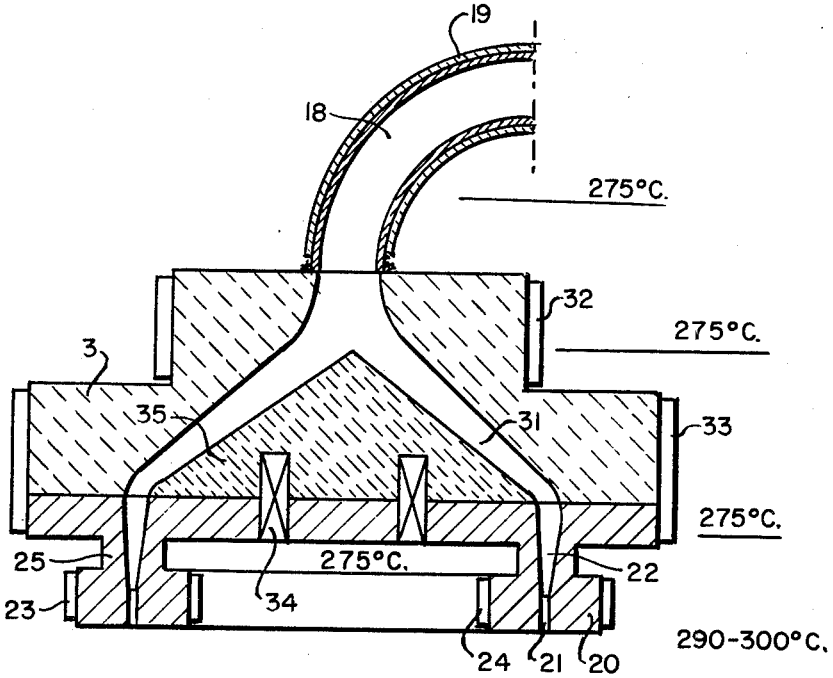
FIG. 3 is a cross-sectional view of an extrusion die.
Figure 4:
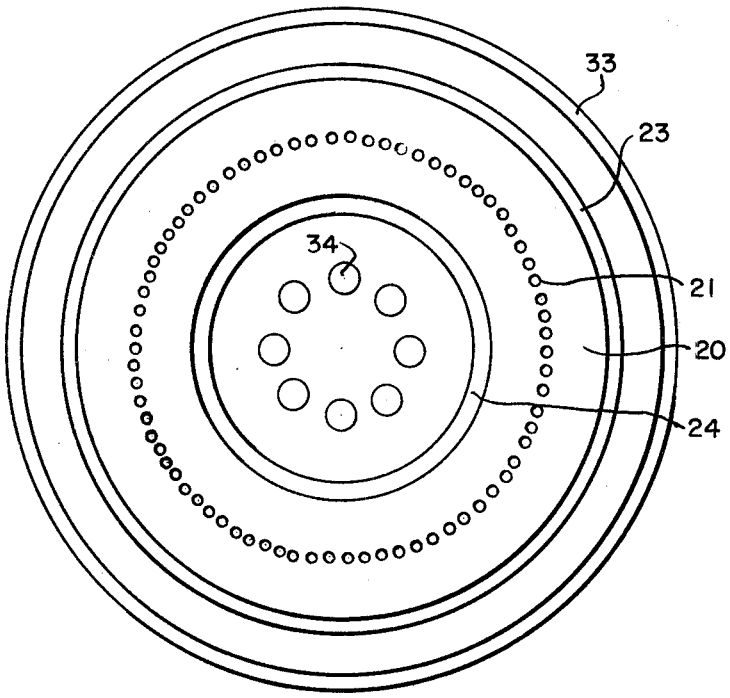
FIG. 4 is a top plan view of the extrusion die of FIG. 3.

FIGS. 3 and 4 illustrate the multiapertured-head design of the extrusion die in accordance with the invention. The mass plasticized in the extruder 1 is fed to the extrusion die 3 through a pipe elbow 18, for example, which is externally provided with heating means 19. The extrusion die comprises distribution ducts 31 for the thermoplastic melt and in the center a part designated as inlet cone 35. The distribution ducts 31 are followed by the nozzle 20 as such, which comprises the nozzle orifices 21 and the nozzle bores 22. As is apparent from the top plan view of FIG. 4, the nozzle orifices are arranged in a single circle. The extrusion die 3 with the nozzle 20 has short flow paths, equal flow-path lengths of the individual nozzles, practically no flow-rate differences, no dead corners, and no unnecessarily high shearing action.

Temperature differences are avoided and a uniform temperature pattern is assured also through uniform heating of the die 3 by means of external heaters 32 and 33 and heating means 34 such as cartridge heaters accommodated within the inlet cone 35.

In order that all nozzle bores 22 and nozzle orifices 21 may be heated uniformly, they are arranged in a single row in a single circle and provided externally and internally with heating means 23 and 24. When the nozzle orifices are arranged in more rows than one, there is an outward drop in temperature with the heating cut out, and an inward drop in temperature with the heating cut in, and these temperature differences result in variations in the diameters of the monofilaments since lower-temperature monofilaments are thicker and monofilaments heated from one side only are deformed by shrinkage, which is a function of melt temperature. The heating means 23 and 24 disposed about the nozzle orifices 21 permit not only uniform heating but also independent heating of the nozzle-orifice area from the rest of the distribution area within the extrustion die 3. Now this also makes it possible to heat the nozzle-orifice area to a high temperature, as proposed in accordance with the invention, to secure smoothing of the monofilament surface. To prevent or minimize heat transfer from the nozzle-orifice area 20 with the nozzle orifices 21 to the extrusion die 3, the nozzle-orifice area 20 is thermally isolated from the extrusion die, for example, in the manner shown in FIG. 3. There the nozzle-orifice area 20 is joined to the rest of the extrusion die only through a narrow-web ring 25 through which the nozzle bores 22 extend. In FIG. 3, the heating temperatures for the various zones are indicated, and it is apparent therefrom that the nozzle-orifice area 20 is heated to a higher temperature than the rest of the extrusion die. The nozzle orifice 21 has a diameter d that is somewhat larger than the diameter of the extruded, cooled monofilament. For example, when the monofilament diameter is 0.6 mm, the nozzle-orifice diameter will be 1.4 mm. These values have to be determined empirically. The length l of the heated path for the nozzle-orifice area must be selected at about 5 to 20×d in order to be effecttive within the meaning of the invention. The nozzle area 20 is preferably heated to a level some 15° to 25° C. higher than that of the remainder of the die and of the PVDF melt entering through the pipe elbow 18.

To secure optimum cooling of the extruded monofilaments 2, a suitable cooling medium such as glycerin is used which provides slow cooling of the monofilaments at depths of immersion which are kept moderate in order to prevent unsteady motion of the monofilaments. However, the depth of immersion must be sufficient to allow adequate solidification of the monofilaments so that they are not deformed as they come in contact with the guide roll 6.

Figure 5:
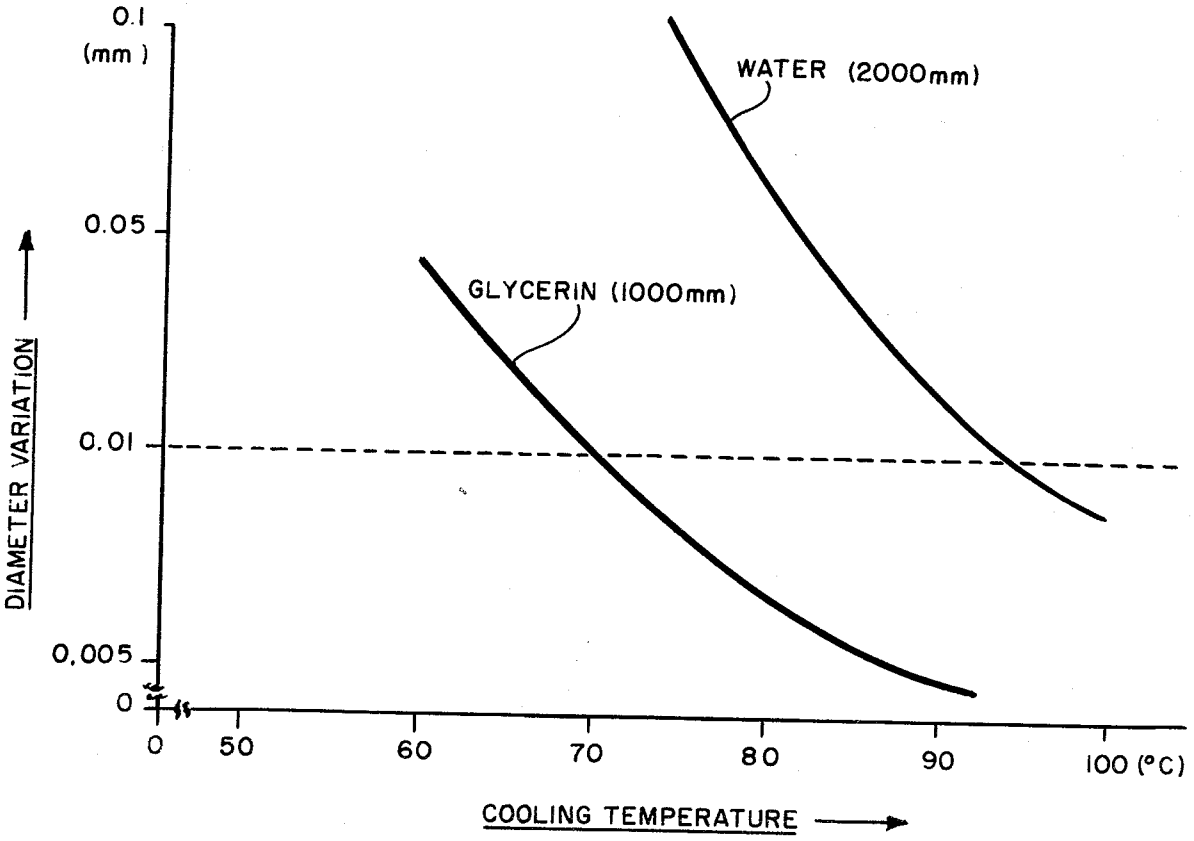
FIG. 5 is a graph plotting the diameter variations of the monofilaments for different cooling media.

Shown in the graph of FIG. 5 are the diameter variations of a PVDF monofilament extruded through a nozzle orifice with a diameter of 1.4 mm, and having after solidification a circular diameter of 0.6 mm, when cooled in a glycerin bath at a depth of immerion of 1000 mm at various cooling temperatures and when cooled in a water bath at a depth of immersion of 2000 mm at various cooling temperatures. It is apparent from that graph that particular requirements as to accuracy of size and shape of PVDF monofilaments can be satisfied by selection of a cooling medium having low conductivity and fairly high damping.

What is claimed is:

1. A process for the production of a monofilament of polyvinylidene fluoride which comprises:

A. extruding polyvinylidene fluoride through a die over a first path and a first extrusion temperature and thereafter over a subsequent path at a temperature of 10 to 30 degrees C. higher than the temperature of said first path and B. then passing the so extruded polyvinylidene fluoride through a cooling bath maintained at a temperature of 60° to 140° C., said cooling bath containing a cooling medium having a thermal conductivity of under 0.40 W/m °K, a viscosity at 100° C. of over 0.5 cp and a density at 100° C. of over 1.1 g/cm$^3$.

2. A process according to claim 1 wherein the so extruded monofilament is immersed in a cooling medium to a depth ranging from 200 to 2000 mm.

3. A process according to claim 2 wherein the so extruded monofilament is immersed in the cooling medium to a depth from 500 to 1000 mm.

4. A process according to claim 1 wherein the cooling medium comprises glycerin.

5. A process according to claim 1 wherein the cooling medium is maintained at a temperature of 90° to 110° C.

6. A process according to claim 1 wherein the cooling medium has a thermal conductivity of under 0.3 W/m °K.

7. A process according to claim 6 wherein the cooling medium has a viscosity at 100° C. of over 1.4 cp.

8. A process according to claim 7 wherein the cooling medium has a density of over 1.2 g/cm$^3$ at 100° C.

9. A process according to claim 1 wherein the monofilaments are treated, after cooling in the cooling medium to remove cooling medium therefrom.

10. A process according to claim 1 wherein the monofilament traverses an air space of 10 to 250 milimeters following extrusion and prior to entry into the cooling medium.

11. A process according to claim 10 wherein the air space which is traversed by the monofilament is 50 to 100 mm long.

12. A process according to claim 1, wherein the monofilament extruded and cooled has a diameter of 0.2 to 1.1 mm.

13. A process according to claim 1, wherein the polyvinylidene fluoride is melt spun.

14. A process according to claim 1, wherein the polyvinylidene chloride is melt spun into a cooling medium comprising 1,2-ethandiol or mixtures with water and glycol or glycerin.

15. A process according to claim 1, wherein the temperature of the subsequent path is 15° to 25° C. higher than that of the first path.

* * * * *